United States Patent [19]

Rich

[11] 3,952,958

[45] Apr. 27, 1976

[54] GRINDER APPARATUS FOR WHEAT, GRAINS, AND THE LIKE

[76] Inventor: Dennis E. Rich, 3810 W. Cholla, Phoenix, Ariz. 85029

[22] Filed: Apr. 7, 1975

[21] Appl. No.: 565,785

[52] U.S. Cl. ..... 241/162; 241/246; 241/259.1; 241/261.1

[51] Int. Cl.[2] ..... B02C 9/04

[58] Field of Search ..... 241/161, 162, 246, 257, 241/259.1, 260.1, 261.1

[56] References Cited

UNITED STATES PATENTS

| | | | |
|---|---|---|---|
| 175,535 | 3/1876 | Webber | 241/261.1 |
| 386,286 | 7/1888 | Ball | 241/257 R |
| 650,291 | 5/1900 | Zimmerman | 241/261.1 X |
| 937,950 | 10/1909 | Nolte | 241/162 |
| 1,159,138 | 11/1915 | Vecchini | 241/257 R |

*Primary Examiner*—Granville Y. Custer, Jr.
*Attorney, Agent, or Firm*—H. Gordon Shields

[57] ABSTRACT

Grinder apparatus for grinding wheat, grains, and the like is disclosed which includes mating conical stones for grinding after the grain has been cracked by a quasi or semi-conical burr which cooperates with a helical cutter groove for the initial cracking of the grain.

10 Claims, 4 Drawing Figures

GRINDER APPARATUS FOR WHEAT, GRAINS, AND THE LIKE

BACKGROUND OF THE INVENTION

1. Field of the Invention

This invention relates to grinder apparatus, and more particularly, to grinder apparatus useable for grinding grains, such as wheat, from the grain to relatively fine flour using a cooperating burr and a helical cutter and a mating pair of conical grinding stones which receive the cracked grain from the burr and helical cutter.

2. Description of the Prior Art

Grinder apparatus of the prior art typically use a pair of generally flat grinding stones or wheels for grinding wheat, and other grains. Such grinding stones or millstones have been used far back into antiquity. While the general design of the grinding stones has not changed, the overall size of the grinding apparatus has decreased substantially. Thus there are now home grinders using the generally parallel grinding stones which are relatively compact, and yet for home use they are rather cumbersome and large, as compared to other household appliances.

Many different forms of power have been applied to turn grinding stones. Or, more nearly correct, to turn one of a pair of grinding stones. The other of the pair of stones generally remains stationary. Beasts of burden have been used to turn grinding stones, and water power, such as water wheels, have also been used to turn the stones. In recent decades, electric motors have been used to turn grinding stones.

It is highly desirable to turn the stones at a relatively slow surface speed so as to produce a minimum of heat. With a motor speed of between about 1000 and 1750 rpm, the way to reduce the surface speed is to minimize the diameter of the grinding stones. Most of the grinders of the prior art have used flat stones, in which the diameter is maximized, thus producing relatively high surface speeds.

Heat is generated by the friction of the material to be ground, or being ground, as one of the grinding wheels or stones moves or rotates with respect to the other one. The desirability of maintaining a relatively low grinding surface speed so as to avoid excessive heat is for two reasons. The first reason is to avoid burning or scorching the material being ground. The second reason is of more recent discovery, and that is simply to avoid a destruction of the food value or nutrients in the material being ground. It may be expressed that the two primary reasons for avoiding heat are substantially interrelated. That is, if heat is sufficient to scorch or burn the flour or other material being ground, there will be an accompanying destruction of some of the food value in the material.

With respect to home use, the popularity of home grinders is increasing. The idea behind home grinders may be attributed to the concepts of freshness, increased food value, and convenience. By purchasing wheat, rice, or other grains in bulk, a householder has the convenience of making bread or other grain products at his convenience. When one grinds his own wheat, the product is certainly fresher than a product which is commercially made. Moreover, there may be a substantial saving in cost in purchasing the raw grains, converting the grain to flour, and then making the end product for home consumption. There are some nutritionists who claim that a substantial amount of the food value present in the whole grain is lost in the grinding and manufacturing or baking process, as commercially exploited. Those same nutritionists feel that the same food value is not lost, but rather is retained in the product home-made from home-ground grain products. Accordingly, recent years have seen a resurgence of home grinding apparatus for the typical home owner.

Such home grinding apparatus is, as pointed out above, generally larger than is desirable in the contemporary kitchen. Due to the generally "large" diameter of the grinding stones, which is typically about 8 inches, the housing for the grinding apparatus tends to be larger than most householders desire. The apparatus of the present invention does not utilize a pair of flat grinding wheels, but rather uses a pair of generally mating conical grinding wheels which provide for a much more compact grinding apparatus than is found in the prior art. Moreover, the apparatus described herein, because of the design of the cutters and the grinding wheels, is able to use smaller quantities of energy, as expressed in the terms of a small electric motor, and thus there is a substantial savings in both cost and in energy in the utilization of the present apparatus.

SUMMARY OF THE INVENTION

The invention described and claimed herein comprises grinding apparatus form grains including a generally cylindrical housing, with a burr and helical cutter groove cooperating to receive grain and to feed the grain cut or cracked by the cooperation of the burr and the helical cutter groove into a pair of mating conical grinding stones. The configuration of the grinding stones minimizes the surface speed of the grinding surfaces without a corresponding decrease in the output of the apparatus.

Among the objects of the present invention are the following:

To produce new and useful grinding apparatus;

To produce new and useful grinding apparatus including a burr and a helical cutter groove;

To produce new and useful grinding apparatus including a pair of mating generally conical configured grinding stones;

To produce new and useful grinding apparatus having a compact, cylindrical configuration; and To produce new and useful grinding apparatus for grains including a pair of grooved grinding wheels.

DESCRIPTION OF THE PREFERRED EMBODIMENT

Figure 1:
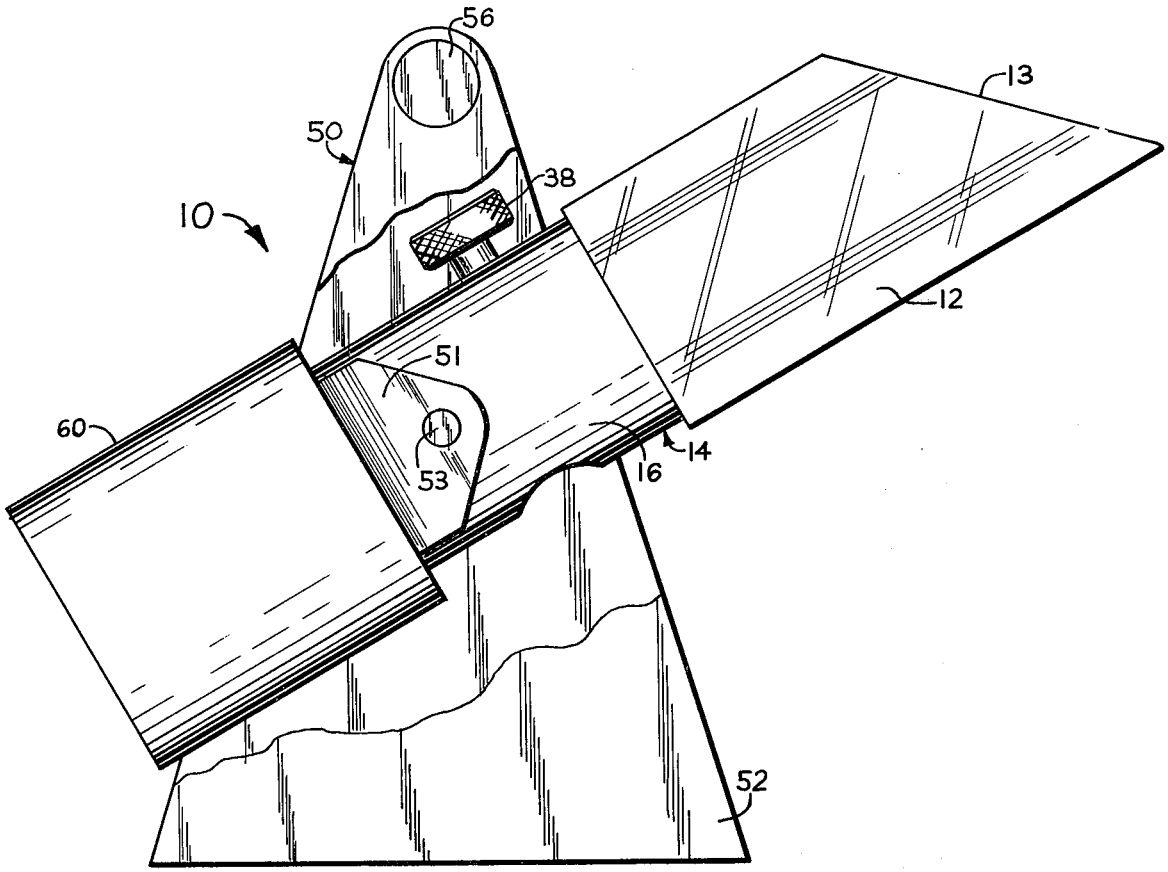
FIG. 1 is view, partially broken away, of grinding apparatus of the present invention.

FIG. 1 is a view of the grinder apparatus 10 of the present invention. The grinder apparatus 10 includes a hopper 12, generally cylindrical in configuration, but truncated as at 13 for ease of receiving the wheat or other grain to be ground. The hopper 12 is, of course, hollow and is preferably made of clear material so as to allow a user or householder to observe at a glance the amount of grain disposed therein. For ease of adding grain, the hopper 12 is truncated or is relieved at its open portion 13 to receive the grain.

The hopper 12 is secured to a grinder portion 14 of the apparatus and the grain feeds from the hopper into the grinder portion 14. The grinder and the hopper are axially aligned with respect to each other and also to a motor portion 60 which is disposed at the opposite end of the grinder portion 14 from the hopper 12. The three primary portions of the grinder apparatus are all cylindrical in configuration.

As shown in FIG. 1, the grinder apparatus 10 includes a frame or stand 50 which supports the grinding portion, the hopper, and the motor. The frame or stand includes a pair of frame sides, of which only frame side 52 may be seen in FIG. 1. The frame or stand includes a handle 56 extending between the frame sides. The grinding apparatus is connected to the stand 50 through a pair of pins, of which pin 53 may be seen in FIG. 1. The pin 53 extends from a yoke 51 to the frame side 52. The yoke 51 is secured to the grinding apparatus and is shown in more detail in FIG. 2.

In FIG. 1 the grinder apparatus 10 is shown in a use environment, with the motor 60, the grinder portion 14, and the hopper 12, disposed at an obtuse angle with respect to the floor, table, or other reference plane upon which the apparatus appears to be disposed. Thus the truncated portion 13 of the hopper 12 is disposed nearly horizontal or nearly parallel with respect to the reference plane on which the apparatus is disposed. For storage, the hopper 12 may be removed from the grinder portion 14 of the apparatus, and the grinder portion and the motor 60 may be aligned substantially perpendicular to the reference plane, which would then result in the motor and the grinder portion being disposed within the frame 50.

Figure 2:
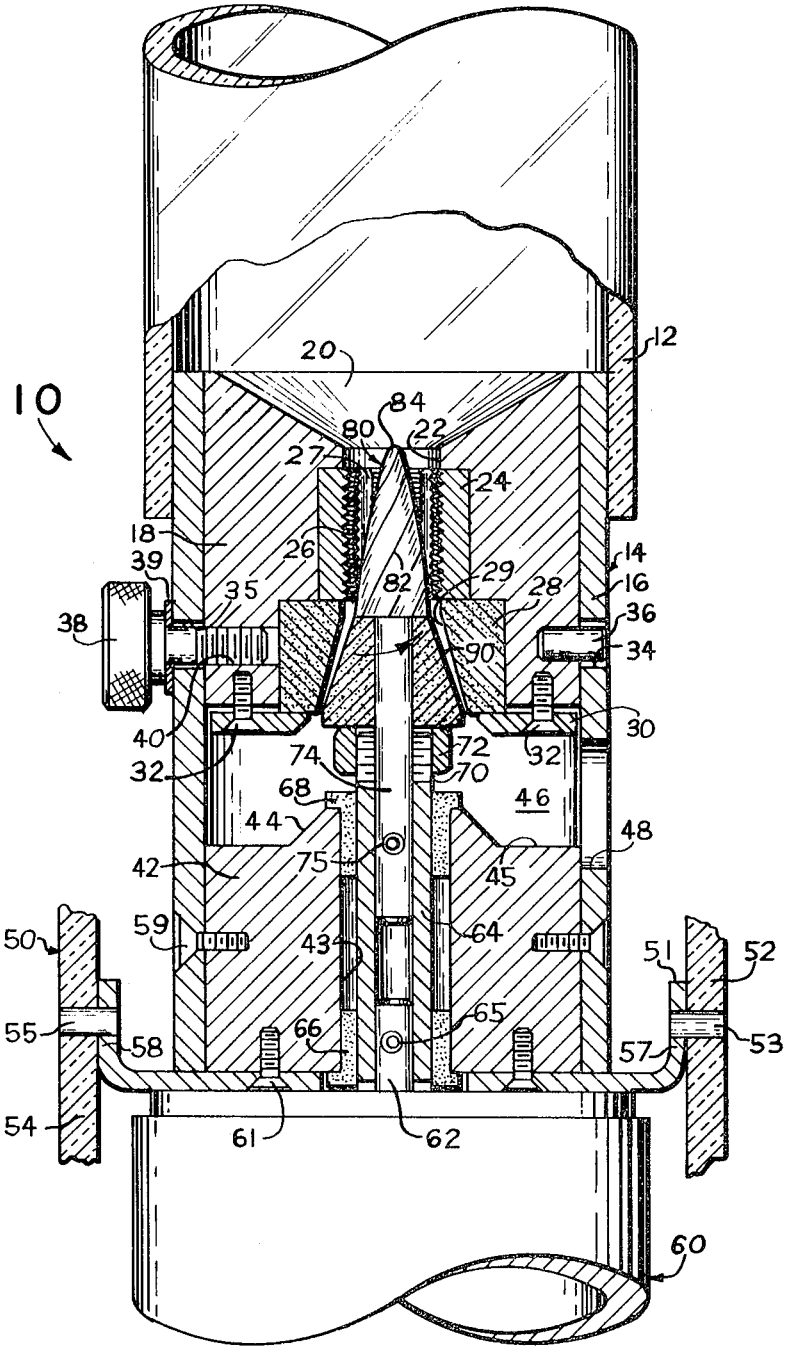
FIG. 2 is a view in partial section of a portion of the apparatus of FIG. 1.

The grinder portion 14 includes a cylindrical housing 16 which engages the hopper 12. A pair of slots, which are not shown in FIG. 1, but are shown in FIG. 2, extend through the housing 16. A pin is secured to a lower hopper portion within the grinder and extends into the slot. The housing 16 is moved on a pair of oppositely disposed pins, including knurled nut 38, which also is disposed within an upper groove substantially matching the lower groove. When the knurled nut 38 is loosened, the housing 16 is rotated on the pins and the knurled nut 38 is then tightened to maintain the relationship or orientation with respect to the grinder apparatus disposed within the housing. This movement, explained in detail below, allows for the relative motion between the fixed or stationary stone and the movable stone to vary the degree of fineness of the material ground by the apparatus.

FIG. 2 is a view in partial section of a portion of the apparatus of FIG. 1, illustrating in detail the cooperating portions of the present invention. The portion of the grinder apparatus 10 shown in FIG. 2 is an enlarged view of primarily the grinder portion 14.

With respect to the grinder portion 14, the housing 16 is shown as a cylindrical housing disposed between the hopper 12 and the motor 60. Hopper 12 is shown disposed about the housing 16, and extending upwardly therefrom. As previously stated, and as illustrated, the hopper 12 is preferably made of transparent material, such as a transparent plastic, and it receives the wheat or other grain to be ground by the apparatus.

Within the housing 16 is a funnel shaped lower hopper, or adjustable holding block 18, which includes a conical portion 20 communicating with the hopper 12. The conical portion 20 of the lower hopper 18 includes a circular cylindrical mouth 22 at the lower portion thereof. The mouth is of a substantially narrower diameter than is the housing 16. The conical portion 20 tapers inwardly from its largest diameter at the outer periphery of the lower hopper, or adjustable holding block and the inward taper terminates at the mouth 22. The mouth in turn is a connecting or communicating aperture between the lower hopper and a cutter 24.

The cutter 24 is preferably made of hardened tool steel, or the like, and is of an external geometric configuration so as to remain fixed and non-rotating within a matching bore in block 18. A cylindrical interior bore extends axially through the cutter. A helical cutting groove 26 is disposed on the inner periphery of the cylindrical bore. A plurality of slots 27 extend generally axially along the interior bore of the cutter and accordingly through the helical cutting groove 26. The slots intersect the threads or groove at nearly a right angle. They provide recesses against which or in which the grain kernels catch and crack as the kernels move downwardly along the groove.

At the bottom of the cutter, or at the lower end of the helical cutter groove 26, is disposed a fixed grinding stone 28. The fixed grinding stone 28 is disposed within a recess in the lower portion of the lower hopper 18. The grinding stone is held in place within the recess by a clamp ring 30. The clamp ring 30 is in turn secured to the adjustable holding block or lower hopper by appropriate fastening means, such as a plurality of screws 32 extending through the clamp ring and into tapped holes within the lower hopper. Since the fixed stone 28 is in abutting relationship with the cutter 24, the cutter is also held in place within the lower hopper 18 by the action of the clamp ring 30. Both the cutter 24 and the fixed or stationary grinder 28 extend into concentric bores within the lower hopper 18. As illustrated in FIG. 2, the bore in which the cutter 24 is disposed is of a lesser diameter than the bore in which the stone 28 is disposed. To prevent rotation of the cutter 24 and the stone 28, the configuration of the bores may not be circular, but may be square or otherwise, or they may be circular and may include a pin, key, or other appropriate means of preventing rotation or relative motion between the adjustable holding block or lower hopper 18 and the cutter and the stone.

The lower hopper or holding block 18 is generally circular in configuration and is disposed within the housing 16, as previously stated. The holding block is not fixed in place with respect to the housing 16, but is movable therein. The movement of the holding block with respect to the housing 16 is accomplished by a system of pins secured to the holding block and slots extending through the housing. A pair of such slots, slot 34 and slot 35, are shown FIG. 2. The slots are cut at an angle with respect to the exterior periphery of the housing and to the longitudinal axis of the housing 16. (See FIG. 1).

A pin 36 is secured within a bore in lower hopper or holding block 18 and the pin extends into the slot 34. The slot 36 receives a shank portion of knurled nut 38, which shank portion extends into a tapped aperture 40 in the holding block or lower hopper 18. A lock washer 39 is disposed between the knurled nut 38 and the exterior periphery of housing 16 adjacent the aperture 35. The knurled nut is used to lock the holding block or lower hopper relative to the housing 16. If it is desired that the holding block be moved relative to the housing 16, and such movement comprises an axial relative movement, the knurled nut 38 is loosened and the housing 16 is then rotated, which results in a camming movement of the pin 36 and the knurled nut 38 with respect to their slots 34 and 35, respectively.

Within the lower portion of the housing 16 is a bearing support block 42 which includes a central frusto-conical portion 44 and an outer circular planar portion. The frusto-conical portion extends upwardly from the planar portion, and an outer circular planar portion 45. The block 42 includes a bore 43 extending axially of the block, and accordingly axially of the housing. The bore 43 receives a hollow shaft 64 which extends substantially therethrough. The shaft 64 is journaled for rotation within the bore 43 by a pair of bearings, lower bearing 66, and upper bearing 68. The lower bearing 66 is disposed at the lower portion of the block and at the lower portion of the housing adjacent motor 60. The upper bearing 68 is disposed within the block 42 at the frusto-conical portion 44 thereof.

The hollow shaft 64 receives a shaft 62 of the motor 60, and the two shafts are pinned together as by an appropriate pin 65. The hollow shaft 64 also receives, at its upper portion, a shaft 74. The shaft 74 is also secured to the shaft 64 by appropriate means, such as pin 75.

The hollow shaft 64 extends upwardly and outwardly, with respect to the block 42 and to the frusto-conical portion thereof, and it includes a threaded outer portion 70. A nut 72 threadedly engages the threaded portion 70 of the shaft 14 adjacent a movable stone 90.

The upper portion of the shaft 74 extends above the hollow shaft 64 and through the movable stone 90 and terminates at a burr 80 to which it is secured. The burr extends into and through the interior of cutter 24 and concentrically with respect to the helical cutter groove 26.

The burr 80 is generally conical in configuration, with a plurality of helically extending grooves 82 on the outer circumference or outer surface thereof. The diameter of the burr increases downwardly from its top, which comprises an upper point 84. Since the interior diameter of the cutter 24 is regular, the distance between the burr and the helical cutter groove 26 decreases downwardly. Thus the kernels of wheat or other grain placed in the hopper 12 fall by gravity into the lower hopper 18 and into the conical portion 20 thereof. The grain continues to flow through the mouth 22 of the lower hopper into the cutter 24. With rotation of shafts 64 and 74, imparted by rotary motion of motor shaft 62, the burr 80 rotates and the grooves 82 of the burr cause a continual feeding of the individual grain kernels downwardly and against the helical cutter groove 26. In this manner the grain is initially cut or cracked as it moves downwardly through an ever-decreasing space between the burr and the helical cutter groove 26. To increase the output of the apparatus, multiple threads may be used in the cutter. That is, the helical cutter groove 26 may be a plurality of grooves, or multiple threads. Each of the threads or grooves would or may originate on the top or upper portion of the cutter 24 adjacent the mouth 22 of the lower hopper and extend downwardly, parallel to each other. If a kernel is picked up in each thread, the output would be increased by increasing the number of threads.

Disposed beneath burr 80 on shaft 74, and above nut 72, is the movable grinding stone 90. The grinding stone 90 is secured to the shaft by the bias of nut 72. The configuration of the movable grinding stone 90 is substantially that of a truncated cone, with the diameter of the stone increasing downwardly from adjacent burr 80. The diameter of the grinding stone 90 adjacent the burr 80, or abutting thereto, is substantially that of the lower portion of the burr. From the burr downwardly about the shaft the diameter of the grinding stone 90 increases.

The fixed or stationary grinding stone 28 includes an interior grinding surface 29 which is generally conical in configuration, and the conical exterior of the movable grinding stone 90 generally fits within the stationary grinding stone 28. The exterior surface of grinding stone 90 thus is substantially complementary to that of the interior grinding surface 29 of the stationary grinding stone 28. The direction of rotation of the shafts, the movable grinding stone 90, and the burr 80 are indicated by a large arrow.

Figure 3:
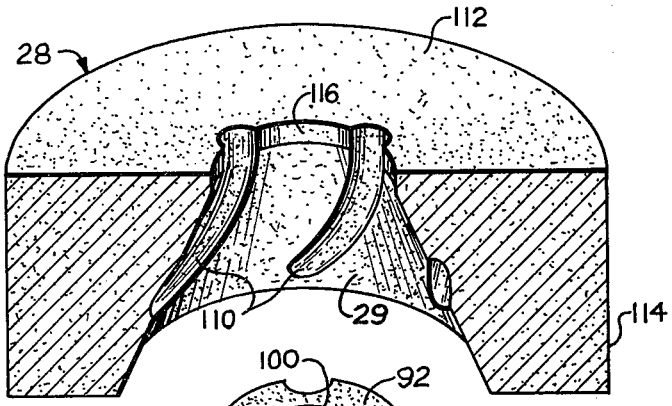
FIG. 3 is a perspective view, in partial section, of the stationary grinding stone used in the present invention.
Figure 4:
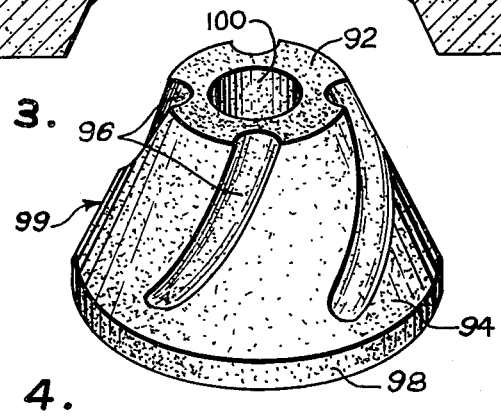
FIG. 4 is a perspective view of the movable grinding stone used in the present invention.

As illustrated in FIG. 2, the taper of the interior grinding surface 29 of the stationary grinding stone 28 is different from the taper on the exterior grinding surface of the movable grinding stone 90. The exterior diameter of the upper portion of the movable grinding stone 90 adjacent the lower portion of burr 80 is somewhat less than the minimum interior diameter of the grinding surface 29 of the stationary grinding stone 28, which minimum interior diameter is at the upper portion of the fixed or stationary grinding stone and is also adjacent the burr 80. Accordingly, as the cut grain moves downwardly through and from the helical thread(s) or groove(s) of the cutter 24 under the urging of the rotating burr 80 and into the grinding stones, the larger particles of the grain kernels are steadily subjected to a lessening space or distance between the grinding surfaces of the burr and cutter first and then the stones. At the lower portion of the fixed grinding stone 28, which is that portion of greatest diameter of the grinding stone, the exterior diameter of the rotating or movable grinding stone 90 is substantially the same as that of the fixed grinding stone at that location. Accordingly, the resulting flour or other grain ground by the apparatus is quite fine. While it is not illustrated in FIG. 2, FIGS. 3 and 4 show details of the grinding surfaces of the grinding stones, including grooves therein.

The fineness of the material ground by the apparatus may be varied by increasing the distance between the grinding surfaces of the stones. This is accomplished by means of the pins and the slots as described above. That is, the knurled nut 38 is loosened and the housing 16 is rotated upwardly, or downwardly, as desired, to increase or decrease the distance between the fixed and the rotating grinding stones. Since the shaft 74 is fixed with respect to the housing 16, the burr and the rotating or movable grinding stone 90 are also fixed with respect to the housing 16. When the housing is rotated, the adjustable holding block or the lower hopper 18 is accordingly moved axially by the camming action of the slots 34 and 35 of the housing 16 against the pin 36 and the knurled nut 38, respectively, with respect to the burr and to the grinding stone 90. The cutter and the stationary grinding stone are accordingly moved relative to the rotating burr and the movable grinding stone.

The flour, or other ground grain, moves downwardly from the grinding stones at the conclusion of the grinding cycle and into a bin portion 46. The bin portion 46 is defined by the housing 16, the grinding stones and the clamp ring 30 associated with lower hopper 18, and the upper portion of the bearing support block 42. The flour or other grain drops or moves outwardly from the bin 46 through an aperture 48 which extends through the housing 16. With the grinding apparatus disposed at an angle, as illustrated in FIG. 1, the aperture 48 is located at the lowest portion of the bin 46 and the flour or other ground grain drops therethrough. A receptacle may be placed beneath the grinding portion 14, and beneath the aperture 48, to receive the flour or other ground grain emanating from the aperture 48.

At the juncture of the housing 16 and the motor 60 is a yoke 51. The yoke is a generally U-shaped member secured to the motor and to the housing 16 and it serves to secure the grinding apparatus, including the hopper, the grinder portion, and the motor, to the frame 50. The yoke 51 includes a pair of oppositely disposed arms 57 and 58. The frame or stand 50 includes a pair of frame sides 52 and 54 which are respectively pinned to the yoke arms 57 and 58. The yoke arms are pinned to the frame sides by a pair of pins 53 and 55. The use of the pins to secure the yoke arms to the frame sides allows relative motion as by pivoting on the pins, between the frame 50 and the grinder portion 14.

Appropriate fastening means, such as a plurality of screws 59 and 61, are used to secure, respectively, the housing 16 to the block 42, and the block 42 to the yoke 51.

FIG. 3 is a perspective view, in partial section, of the stationary or fixed grinding stone 28 used in the present apparatus. The stone 28 is generally cylindrical in configuration, with an interior grinding surface 29 which is generally conical in configuration, or rather generally in the form of a truncated cone. The grinding stone 28 is accordingly of substantially thick walls which define an interior surface 29 used for grinding. The interior surface includes a plurality of generally parallel grooves 110 which extend along the interior surface of the grinding stone in the general direction of the longitudinal axis of the cone and of the grinding stone. The grooves are slightly curved, and they extend at a skew angle or angularly, with respect to the conical grinding surface.

The grinding stone 28 includes a top surface 112 and a cylindrical exterior wall 114. The stone is relatively homogeneous, and accordingly the composition of the stone is relatively uniform throughout. Extending downwardly from the top surface 112 of the grinding stone is a mouth 116. The mouth 116 comprises a cylindrical portion, circular in extent, and generally parallel to the side wall 114. The conical interior surface 29, which is the grinding surface of the stone, extends downwarldy and outwardly from the mouth 116.

Grooves 110 extend downwardly from the upper surface 12 at the mouth 116. The depth of the grooves 110 is maximum adjacent the top surface and the mouth 116, and gradually decreases to a minimum depth upwardly from the lower or bottom portion of the grinding stone. The taper of the depth of the grooves is such that it varies from a maximum at the upper surface to a minimum downwardly and eventually blends with the rest of the interior surface 29 of the stone 28.

FIG. 4 is a perspective view of the movable grinding stone 90 used in the present invention. The stone includes a top upper surface 92 and an exterior grinding surface 94, with a plurality of grooves 96 extending along the exterior grinding surface and angularly oriented with respect to the axis of the grinding stone. The grinding stone is generally also in the form of a truncated cone, substantially complimentary to the interior grinding surface 29 of the fixed stone 28, but not completely complementary.

The upper or top surface 92 of the grinding stone, as shown in FIG. 2, is situated generally within the mouth 116 (see FIG. 3) of the fixed grinding stone 28. The grooves 96 are generally parallel to the grooves 110 of the fixed grinding stone, and their depth is substantially the same, being maximum adjacent the upper surface 92, and decreasing downwardly until they meet the exterior surface 94.

At the bottom or lower end of the grinding stone 90 is a short cylindrical portion 98. Within the grinding stone 90 is a bore 100 which extends downwardly throughout the stone and is along the axis of the stone. The bore 100 receives the upper shaft 74 (see FIG. 2) which shaft is in turn secured to the burr 80 (also shown in FIG. 2). The bottom surface of the burr is disposed upon the top surface 92 of the stone 90.

After grain kernels are cracked between the burr and the helical grooves 26 of the cutter 24, the grains fall into the space between the external surface 94 of the movable stone 90 and the interior surface 29 of the stationary or fixed grinding stone 28. Larger pieces of the grain kernels will move into the grooves 110 or 96 of the stationary or movable stones, respectively, and move downwardly along the grooves as the movable stone 90 rotates within the stationary stone 28. Since the grooves become shallower and shallower downwardly until they eventually blend with the outer grinding surfaces, the relative rotating motion of the stones grinds the kernels according to the space or separation between the two stones. As indicated above, the degree of grinding of the kernels may be controlled by moving the stationary stone relatively with respect to the movable stone, either upwardly or downwardly along the longitudinal axis of the stones to vary the space between them.

The exterior diameter of the upper surface 92 is slightly less than the interior diameter of the mouth 116 of the fixed or stationary stone 28. The diameter of the cylindrical portion 98 of the movable stone 98 is substantially the same as the maximum diameter of the fixed or stationary stone 28. Hence the conical portions of the two grinding stones are not completely complementary. The difference between the stones is shown in FIG. 2. Movement axially of the fixed stone varies the spacing between the two stones to minimize or maximize the spacing. The wider the spacing, the coarser the grind, and the narrower the spacing, the finer the grind.

In addition to varying the degree of fineness of the grains ground in the present apparatus, the time involved in grinding may also be varied by attaching a simple, well known timer to the apparatus. By marking the exterior of the housing adjacent the pin and/or the knurled nut to indicate a relative degree of grinding, the user will have an idea or indication of the appropriate spacing between the fixed and the movable grinding stones for the various types of grains commonly ground in apparatus of this type. Similarly, by providing a timing apparatus, the quantity of grain to be ground may also be predetermined by the user of the apparatus.

By providing multiple threads on the interior of the cutter, the quantity of grain ground by the apparatus is increased. However, the speed or angular rotation of the movable grinding stone may remain relatively constant. Since the grinding stones are conical in configuration, rather than typically flat as in the prior art, and the surface of the conical grinding stones is distributed over a relatively small diameter, the surface speed of the grinding stones is relatively slow, which produces far less heat during the grinding operation than the grinding apparatus of the prior art, which includes the flat stones.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Grinder apparatus, comprising, in combination:

a cutter adjacent the hopper means, including a cylindrical bore extending axially through the cutter, a helical cutting groove in the bore, and slot means extending axially in the bore through the groove;

first grinding means having a conical grinding surface disposed in the cylindrical bore of the cutter and movable relative to the cutter;

fixed grinding means disposed adjacent the cutter and having a conical shaped interior grinding surface; and a second grinding means having a conical grinding surface disposed in the fixed grinding means and movable relative to the fixed grinding means.

2. The apparatus of claim 1 in which the first grinding means includes a plurality of helically extending grooves on its grinding surface.

3. The apparatus of claim 1 in which the fixed grinding means includes a plurality of grooves on its grinding surface.

4. The apparatus of claim 3 in which the second grinding means includes a plurality of grooves on its grinding surface.

5. The apparatus of claim 4 in which the grinding surfaces of the fixed grinding means and second grinding means are substantially complementary to each other.

6. The apparatus of claim 5 in which the first grinding means and the second grinding means are secured together.

7. The apparatus of claim 6 in which the cutter and the fixed grinding means are axially movable relative to the first grinding means and the second grinding means for increasing and decreasing the distance between the cutter and the fixed grinding means secured thereto and the first and second grinding means.

8. The apparatus of claim 4 in which the grooves on the grinding surfaces of the fixed grinding means and the second grinding means vary in depth from a maximum adjacent the cutter and the first grinding means, respectively, to a minimum on the said surfaces.

9. The apparatus of claim 1 in which the slot means intersects the helical cutting groove at nearly a right angle.

10. The apparatus of claim 9 in which the slot means comprises a plurality of axially extending slots on the inner periphery of the bore of the cutter.

* * * * *